United States Patent [19]

MacDonald

[11] 4,427,246

[45] Jan. 24, 1984

[54] DRAWER GUIDE SYSTEM

[75] Inventor: Paul M. MacDonald, Scituate, Mass.

[73] Assignee: Dickran Babigian, Trustee, West Newton, Mass.

[21] Appl. No.: 297,242

[22] Filed: Aug. 28, 1981

[51] Int. Cl.[3] ..... A47B 88/04

[52] U.S. Cl. ..... 312/330 R; 312/341 R; 312/345; 312/348

[58] Field of Search ..... 312/330 R, 333, 341 R, 312/348, 345, 347

[56] References Cited

U.S. PATENT DOCUMENTS

| | | | |
|---|---|---|---|
| 318,114 | 5/1885 | Hull | 312/330 |
| 732,721 | 7/1903 | Dunning | 312/348 X |
| 2,133,639 | 10/1938 | Smith et al. | 312/333 |
| 3,511,550 | 5/1970 | Hilfinger et al. | 312/330 R |
| 3,658,399 | 4/1972 | Vogt | 312/333 X |
| 3,797,906 | 3/1974 | Gutner | 312/330 |
| 4,305,625 | 12/1981 | Gutner et al. | 312/330 X |

*Primary Examiner*—James T. McCall
*Assistant Examiner*—Joseph Falk

[57] ABSTRACT

A roller guide is disclosed for use in providing a roller support and guide for a drawer. The guide is comprised of a rail mountable to the cabinet frame under the drawer parallel to the path thereof. The rail is in the form of a U-shaped channel piece with outwardly extending flanges. The guide also includes a bracket mountable to the rear lower portion of the drawer and carrying a roller which rides in the channel of the rail. The bracket is formed with a pair of re-entrant slots which engage the flanges to provide a positive locking, sliding connection between the drawer and the rail.

3 Claims, 5 Drawing Figures

DRAWER GUIDE SYSTEM

BACKGROUND OF THE INVENTION

1. Field of the Invention

This invention relates generally to drawer guides and more particularly is directed towards a drawer guide system involving a fixed rail and a roller bracket slidably locked thereto and fastened to the drawer.

2. Description of the Prior Art

Conventional drawer supports usually include a pair of side rails mounted to the cabinet frame on either side of the drawer. The rails engage a fixed slide member on the drawer or, in some instances, rollers are employed either on the drawer or on the cabinet or both, these being mounted on either side of the drawer and roll along the guide rails. While such drawer guides have long been in use they have a number of drawbacks particularly from a cost of fabrication standpoint. Drawer construction using sets of rollers and rails along both sides of the drawer are incorporated only in large drawer systems and require relatively precision assembly to ensure proper alignment of the components. Further, the rollers must be lubricated periodically to ensure proper operation. Also, drawers supported by this type of system are frequently difficult to separate from the cabinet and to reposition in the cabinet if the drawer is to be replaced. Even drawers not using rollers but merely having fixed slides are unsatisfactory. First of all, the parts must be precisely aligned to ensure that the drawer will fit and move properly within the slideway. If the drawer and the cabinet are both made of wood, the friction between the moving parts may be objectionable and any warping of the wood frame may cause the drawer to bind.

In U.S. Pat. No. 3,980,365 there is disclosed a drawer rail system in which a single overhead rail is fixed to the cabinet and slidably engages a guide. This type of system is self-aligning, simple and provides easy movement of the drawer. For some drawer systems however another drawer support and guide arrangement is more appropriate for use either by itself or in conjunction with an overhead system of the sort referred to above.

However, heretofore there has been no simple, low cost and efficient under-the-drawer type support and guide for a drawer system. Accordingly, it is an object of the present invention to provide a new and improved drawer support and guide.

Another object of this invention is to provide a simple low cost combination drawer support and roller guide system characterized by a sliding locking action between the drawer and the guide.

SUMMARY OF THE INVENTION

This invention features a drawer support and guide system comprising a rail mountable to the cabinet containing the drawer in a position below the drawer and extending lengthwise thereof. A bracket carrying a roller is mountable to the rear of the drawer and is adapted to ride in the rail, supporting the drawer thereby and guiding the movement of the drawer along the rail. The rail is formed with a pair of longitudinal flanges which slidably lock with a pair of re-entrant openings formed in the bracket on both sides of the rollers to provide a sliding locking connection between the roller bracket and the rail.

DETAILED DESCRIPTION OF THE PREFERRED EMBODIMENT

Figure 1:
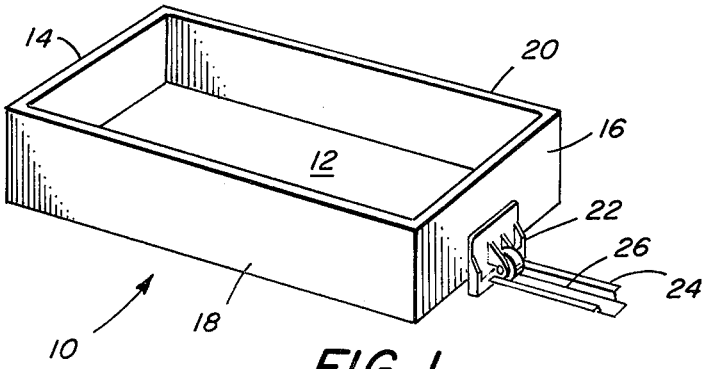
FIG. 1 is a view in perspective of a drawer operably connected to a support guide system made according to the invention.
Figure 3:
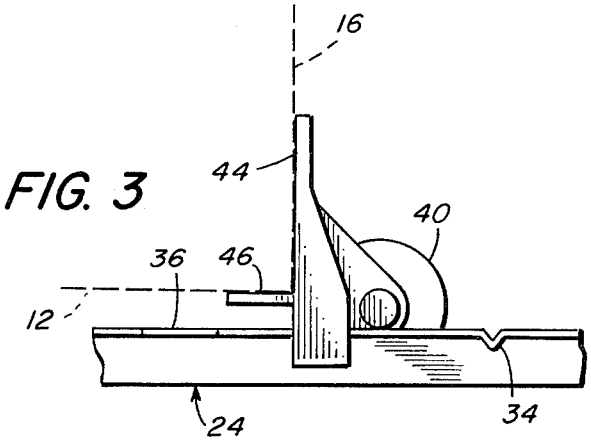
FIG. 3 is a view in side elevation of the bracket and the rail combination.

Referring now to the drawings, the reference character 10 generally indicates a drawer mountable to a cabinet of any one of a number of different types such as kitchen cabinet, file cabinet, bureau and the like, and, typically, is comprised of a bottom wall 12, front and rear walls 14 and 16, respectively, and side walls 18 and 20. The drawer 10 is generally of standard construction but is mounted for support and guidance to the cabinet by means of a rolller bracket 22 and rail 24 made according to the invention. The rail in the preferred embodiment is fabriacted from metal, preferably steel, and has an overall length sufficient to extend from front to rear of the cabinet in which it is mounted, the front end being supported in the middle of the drawer frame opening and the rear being mounted to the back wall of the cabinet frame, or the like. The rail is located along the path of movement of the drawer and, typically where only one rail is required for the drawer, it is located along the center of the drawer below the bottom wall thereof.

The rail is U-shaped in cross-section defining a relatively shallow trough 26, typically about $\frac{1}{4}''$ deep and about $\frac{3}{4}''$ wide, with the side walls 28 and 30 extending upwardly and outwardly to terminate in a pair of outwardly extending flanges 32 and 34 lying in the same horizontal plane. Typically, the overall width of the rail is approximately $1\frac{1}{4}''$ although these dimensions are only by way of example and can be increased or decreased according to particular applications. The width of each flange 32 and 34 typically is about 3/16" and also may be varied as desired. The ends of the rail 24 typically are perforated to receive fasteners such as screws or the like for mounting the rail to the cabinet. The rail in the preferred embodiment is also formed with a detent stop 34 in the form of a notch formed transversely across the flanges to prevent accidental removal of the drawer from the cabinet. The flanges also may be cut away at 36 to allow the bracket 22 to disengage from the rail in the event that the drawer is to be removed from the cabinet.

Figure 5:
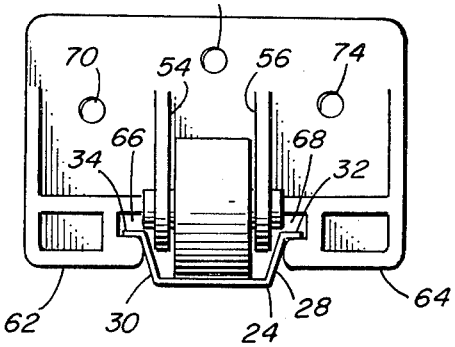
Figure 4:
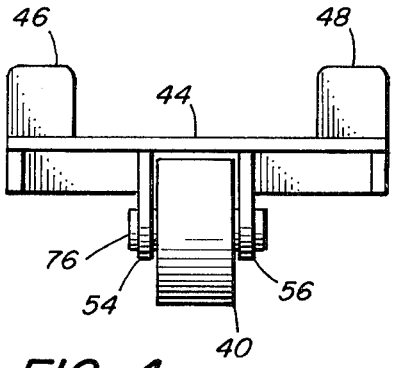
FIG. 4 is a top plan view of the bracket, and, FIG. 5 is a front elevation thereof together with the rail.
Figure 2:
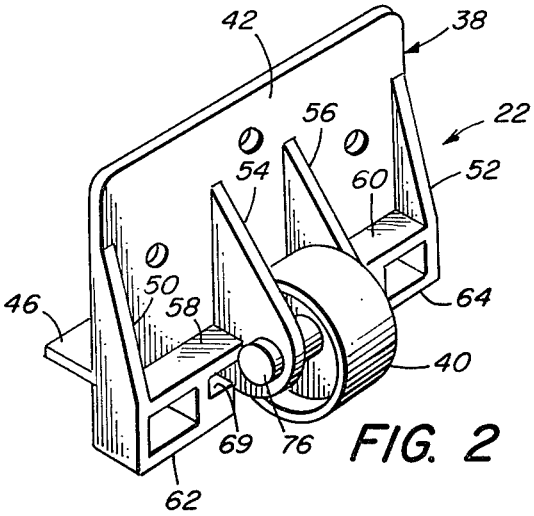
FIG. 2 is a view in perspective showing the roller bracket employed in the system.

The bracket 22 is comprised of a body portion 38, typically of one piece molded plastic construction, and a roller 40 rotatably mounted thereto. The bracket body is comprised of a vertical wall section 42 having a flat forward face 44 adapted to fit flush against the rear wall 16 of the drawer with a pair of forwardly extending perpendicular, horizontal tabs 46 and 48 adapted to extend in under the lower edge of the rear wall 16 against the rear edge of the bottom wall 12 of the drawer to provide support and to position the drawer with respect to the bracket. Formed in the rear of the wall are strengthening ribs 50 and 52 and a pair or parallel rearwardly extending ears 54 and 56 which support the roller 50 therebetween. Cross ribs 58 and 60 join the ears 54 and 56 to the outer ribs 50 and 52 while along the bottom edge of the wall are inwardly extending ribs 62 and 64 terminating close to the ears 54 and 56 but spaced therefrom to form a pair of re-entrant openings 66 and 68 on either side of the roller. These openings are adapted to receive the flanges 32 and 34 of the rail, as best shown in FIG. 5. The openings 66 and 68 form shoulders 69 which underlie the flanges so that when the bracket is slipped onto either end of the rail or through rail openings 36, the bracket will lockably and slidably engage with the rail with the roller positioned to ride along the center of the rail in the manner illustrated. This provides a smooth rolling action and offers very firm support to the drawer. The bracket itself is attached to the drawer by suitable fastening means such as screws passing through openings 70, 72 an 74 in the wall 42, by staples or the like.

The roller 40 is supported on the ears 54 and 56 by means of an axle 76 formed integral with the roller and passing through cooperating holes formed in the outer portions of the ears. The roller is readily assembled to the bracket by bending the bracket along its vertical centerline sufficiently to separate the ears and allow insertion of the axle 76 in the holes in the ears. When the wall is released, it will return to its flat condition, firmly holding the roller in place.

Because of the nature of the plastic materials used in the bracket it is not normally necessary to lubricate the roller or for that matter either the rail or any other part of the bracket. In the event that a particularly heavy drawer is in use two or more rails and roller brackets may be installed side by side. However, for most common uses a single rail and roller bracket is all that is necessary to provide proper support and guidance.

While the invention has been described with particular reference to the illustrated embodiment, numerous modifications thereto will appear to those skilled in the art.

Having thus described the invention, what I claim and desire to obtain by Letters Patent of the United States is:

1. A system for supporting and guiding a drawer for opening and closing the same within a cabinet comprising (a) a rail mountable to said cabinet, and, (b) a roller bracket mountable to said drawer, (c) said rail being formed with a longitudinal trough and a pair of outwardly extending co-planar longitudinal flanges along the sides of said rail, (d) said bracket including a roller rotatably mounted thereto and adapted to ride along said trough, (e) said bracket being formed with a pair of re-entrant openings, one on each side of said roller and adapted to receive said flanges when said bracket is connected to said rail, (f) said bracket formed with a flat forward face adapted to engage the rear wall of said drawer and at least one lip perpendicular to said face extending from said face to engage a rearward edge of the bottom wall of said drawer.

2. A system according to claim 1 wherein said rail is formed with openings in the flanges thereof to allow passage of said bracket therethrough, and wherein said bracket is formed with a pair of spaced parallel ears extending rearwardly thereof and rotatably supporting said roller, and wherein said re-entrant openings are located on each side of said ears.

3. A system according to claim 2 wherein said bracket is fabricated of a generally stiff and somewhat resilient plastic material adapted to be bent sufficiently to allow separation of said ears for mounting said roller therebetween, and wherein said roller is fabricated of plastic and is formed with an integral axle.

* * * * *